US007546799B2

(12) United States Patent
van Beuningen

(10) Patent No.: US 7,546,799 B2
(45) Date of Patent: Jun. 16, 2009

(54) WASTE BIN PROVIDED WITH MEANS FOR COMPRESSING WASTE

(75) Inventor: Robert-Jan Willem Antoine van Beuningen, Eindhoven (NL)

(73) Assignee: Brabantia Nederland B.V., Waalre (NL)

( * ) Notice: Subject to any disclaimer, the term of this patent is extended or adjusted under 35 U.S.C. 154(b) by 0 days.

(21) Appl. No.: 11/899,432

(22) Filed: Sep. 6, 2007

(65) Prior Publication Data

US 2008/0053318 A1 Mar. 6, 2008

(30) Foreign Application Priority Data

Sep. 6, 2006 (NL) ..... 2000214

(51) Int. Cl.
*B30B 5/02* (2006.01)
*B30B 13/00* (2006.01)

(52) U.S. Cl. ..... 100/211; 100/35; 100/227; 100/233; 100/265; 100/295; 220/908

(58) Field of Classification Search ..... 100/35, 100/42, 214, 226, 227, 233, 902; 220/908, 220/908.1

See application file for complete search history.

(56) References Cited

U.S. PATENT DOCUMENTS

| | | | | |
|---|---|---|---|---|
| 2,481,611 A * | 9/1949 | Moore | ..... | 53/525 |
| 3,736,863 A | 6/1973 | Brucker | | |
| 7,273,155 B1 * | 9/2007 | Gray | ..... | 220/495.04 |

FOREIGN PATENT DOCUMENTS

| | | |
|---|---|---|
| GB | 1325659 | 8/1973 |
| JP | 2002114306 | 4/2002 |

* cited by examiner

*Primary Examiner*—Jimmy T Nguyen
(74) *Attorney, Agent, or Firm*—The Webb Law Firm

(57) ABSTRACT

A waste bin, including a container for holding waste and having a cover, and further including compressing mechanisms for compressing the waste inside the container, wherein the compressing mechanisms are displaceable between a nominal position and a compression position, wherein the compressing mechanisms in the compression position are configured to be moved inwards with respect to the nominal position to compress waste inside the container, wherein the compressing mechanisms form a part of the container that is movable at least transversely to the longitudinal axis of the waste bin.

20 Claims, 6 Drawing Sheets

WASTE BIN PROVIDED WITH MEANS FOR COMPRESSING WASTE

CROSS-REFERENCE TO RELATED APPLICATION

This application claims priority under 35 U.S.C. §119(a-d) to Netherlands Application No. NL 2000214, filed Sep. 6, 2006.

BACKGROUND OF THE INVENTION

1. Field of the Invention

The invention relates to a waste bin, comprising a container provided with a cover, in which waste, such as domestic waste, can be held, as well as compressing means for compressing waste which is inside the container and which are displaceable between a nominal position and a compression position, the compressing means in the latter being moved inwards with respect to the nominal position, for compressing waste which is inside the container.

2. Description of the Related Art

A waste bin of this type is known from British patent 1,325,659. With this known waste bin, a compressor is accommodated in the cover, which is attached to the outer bin. The underside of the cover is provided with a bellows which is connected on the underside to a pressure plate. When the cover is closed, the compressor is activated in such a manner that compressed air can be supplied to the space formed between the cover, the bellows and the pressure plate. This results in an expansion of the bellows, as a result of which the pressure plate is moved downwards into the inner bin. Thus, the waste inside the latter is compressed. In order to be able to supply the reaction force required for the compression, the cover is locked with respect to the outer bin in the closed position.

During the reciprocating movement which takes place as part of the compressing action, the pressure plate is guided by a number of telescopic guides, in such a manner that it remains more or less horizontal. This is necessary in order to prevent the pressure plate from becoming stuck due to oblique positions and the like. Furthermore, a tension spring is provided between the cover and the pressure plate, which tension spring has to ensure that the pressure plate is moved upwards when the action of the compressor is stopped. For the purpose of the correct operation of all components, electric switching and control means are furthermore provided, in such a manner that the compressor can only be activated when the cover is locked.

Compressing waste in the waste bin may be desirable for various reasons. In the first place, compression reduces the total volume of the collected waste, in such a manner that more waste can be accommodated in the waste bin. In addition, it may be desirable to compress the waste in a plastic bag which is accommodated in the inner bin. The waste then has to be pressed down slightly in order to be able to close the bag properly at the top in order to dispose of it.

Although the known waste bin can compress the waste, it has several disadvantages. Firstly, the cost price of such a waste bin is high, due to the large number of moving parts, the precise finishing in order to ensure a closed space between the cover, bellows and pressure plate, the electric control unit and the like. Furthermore, such a waste bin is relatively susceptible to failures, partly due to the fact that it comprises so many moving parts.

SUMMARY OF THE INVENTION

It is therefore an object of the invention to provide a waste bin of the abovementioned type, that is to say a waste bin in which the waste can be compressed, which is of a relatively simple construction and which is therefore more reliable in terms of operation and less expensive. This object is achieved by the fact that the compressing means comprise a part of the container which can be moved at least transversely to the longitudinal axis of the waste bin.

In the waste bin according to the invention, no separate pressure plate is used, which is suspended from the cover, but the container itself or a part thereof is used to achieve compression of the waste collected therein. Furthermore, it is known that the container comprises an outer bin and an inner bin accommodated in the outer bin, in which the waste can be accommodated, the compressing means comprising a part of the inner bin which can be moved at least transversely to the longitudinal axis of the waste bin. In particular, said compression of part of the inner bin may be effected by hand, as the inner bin already has to be accessible by hand in order to be removed from the outer bin and in order to remove any plastic bag from the inner bin.

Several different measures are conceivable in order to compress a part of the inner bin. Thus, for example, the top of the waste bin could be designed to have a number of strips arranged in the peripheral direction, which can be moved with respect to one another in the manner of a diaphragm between a nominal, open position and an inward compression position. However, a simple embodiment is preferred in which the inner bin comprises a rigid sub-bin as well as a flexible sleeve which is arranged on the sub-bin. By means of such a flexible sleeve, which has to be of a certain height so that it can be deformed inwards over a certain distance, the waste collected in the waste bin can be compressed in a very simple and effective manner.

According to a preferred embodiment, provision may be made for at least one handle to be arranged on the flexible sleeve in order to move the sleeve manually between the nominal position and the compression position. By means of such handles, preferably two handles which are arranged diametrically opposite one another, the flexible sleeve can easily be gripped and be operated in order to compress the waste. It is also possible to lift the inner bin out of the outer bin in a simple manner by means of these handles.

In this connection, each handle is preferably made from a relatively rigid material. According to a further preferred embodiment, each handle is at a distance beyond the upper edge of the sleeve. Such a variant is useful if a flexible bag has to be accommodated in the inner bin, in which flexible bag the waste is to be accommodated. Such a flexible bag can be arranged in the inner bin in such a manner that the edge of the flexible bag can be turned over the top edge of the inner bin and between this top edge and the adjacent handle. The inner bag can thus not be pushed into the inner bin during compression. The added advantage which is achieved in this way is that the inner bin does not become soiled when the waste which is held therein is compressed; even the hands of the user are protected from becoming soiled.

In order to achieve strength, each handle may extend along the sleeve and be attached to the sub-bin. In particular, each handle may in this case be hingedly attached to the sub-bin.

According to a further embodiment, the inner bin may be provided with external supports so that, at a first angular orientation of the inner bin and the outer bin with respect to one another, the supports fit into a relatively wide section of the outer bin in order to accommodate the inner bin completely inside the outer bin, and at a second angular orientation, which differs from the first angular orientation with respect to one another, of the inner bin and the outer bin, the supports can be supported on a relatively narrow section of the outer bin, which section is situated at the top of the outer bin, in order to support the inner bin on the outer bin in a relatively high position.

With this embodiment, the inner bin can be supported on the outer bin in a slightly raised position. Such a slightly raised position is suitable for removing the bag which is filled with waste from the inner bin, without the inner bin having to be removed entirely from the outer bin.

Each handle may be hingedly attached to a support, in such a manner that a compact construction can be achieved. Furthermore, each handle may be designed in such a manner that it fits in a corresponding recess on the top side of the outer bin.

The invention furthermore relates to the use of the above-described waste bin for collecting and compressing waste, comprising the steps of:

placing waste in the inner bin, increasing the waste up to the level of the section delimiting the opening of the inner bin, pressing the section delimiting the opening of the inner bin inwards in order to compress the waste.

According to a variant, the use comprises the steps of:

placing a flexible bag in the inner bin, placing waste in the flexible bag, pressing the section delimiting the opening of the inner bin inwards in order to compress the waste in the flexible bag, closing the flexible bag containing compressed waste, removing the flexible bag containing waste from the inner bin.

Although a waste bin is described above in which the handles are arranged on the inner bin, the handles could also be provided on the outer bin, in which case they are designed so that they can be displaced, for example by means of a flexible or hinged attachment.

BRIEF DESCRIPTION OF THE DRAWINGS

The invention will be described in more detail below with reference to an exemplary embodiment illustrated in the figures, in which.

DETAILED DESCRIPTION OF THE INVENTION

Figure 1:
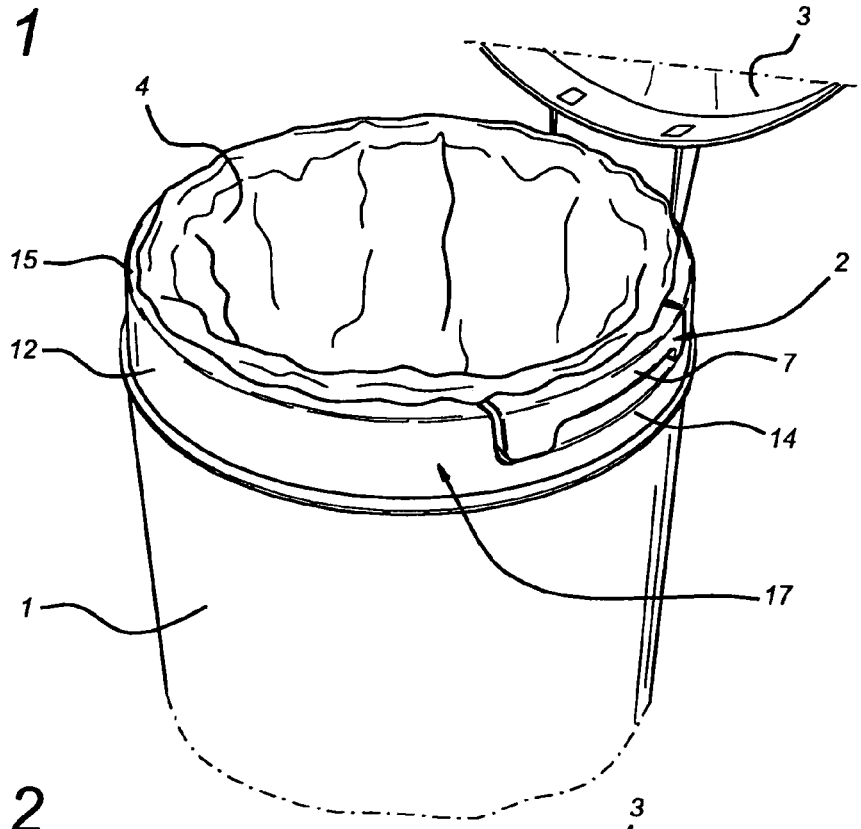
FIG. 1 shows a waste bin according to the invention, with an open cover.
Figure 5:
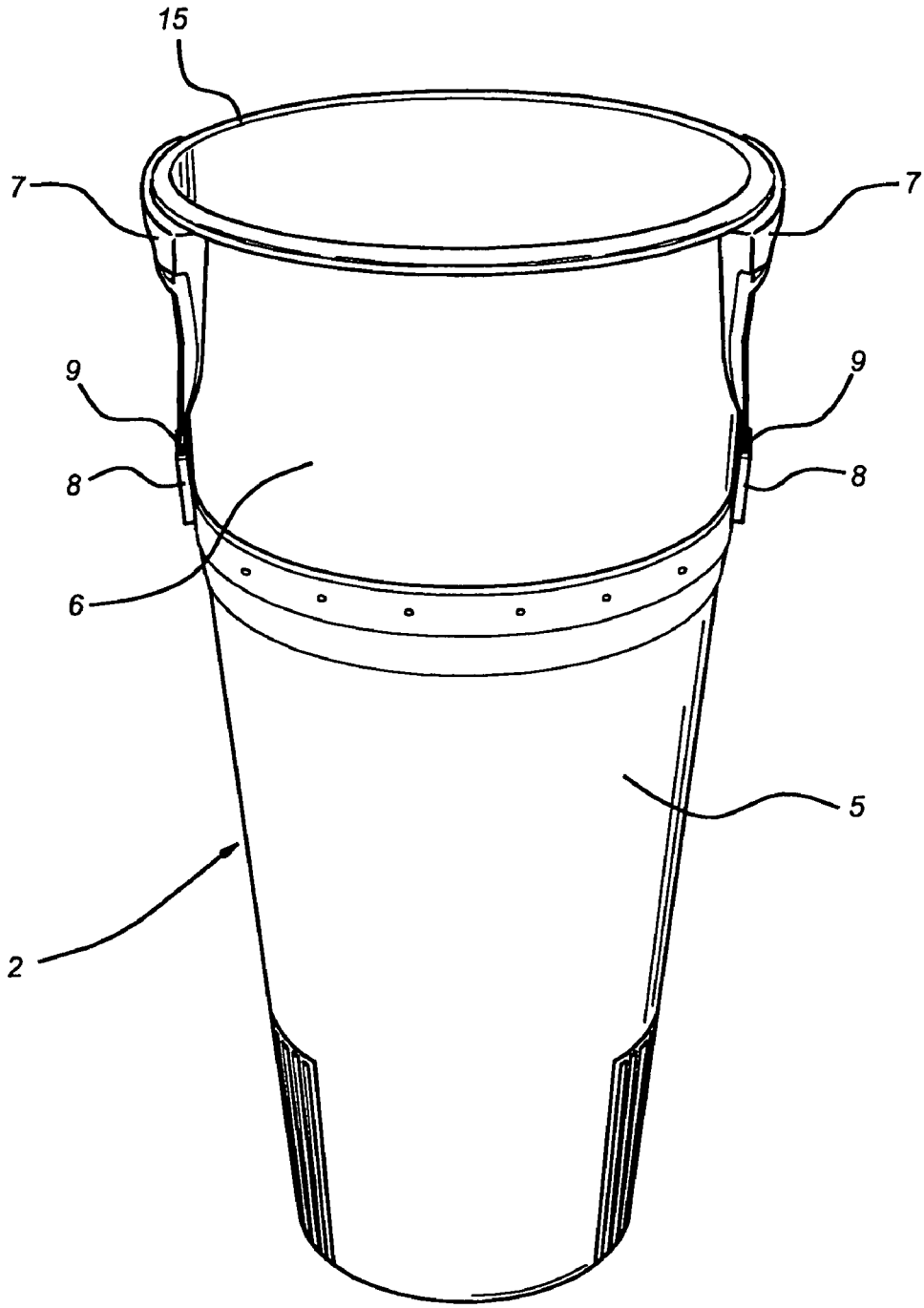
FIG. 5 shows the inner bin.

The waste bin according to the invention illustrated in FIG. 1 comprises an outer bin 1, a partially visible inner bin 2 which is accommodated therein, and a cover 3 attached to the outer bin. A plastic bag 4 is placed inside the inner bin 2. The inner bin 2 is illustrated in its entirety in FIG. 5. This inner bin 2 comprises the sub-bin 5 and the flexible sleeve 6 attached thereto. Two handles 7 are attached to this flexible sleeve 6.

Two supports 8 are also provided at the top of the inner bin 2, at the position where the sleeve 6 is attached thereto. Each handle 7 is attached to an associated support 8 by means of a (resilient) hinge 9. The function of the handles 7 and of the supports 8 will be discussed below.

An amount of waste gradually collects in the plastic bag 4 which is inside the inner bin 2, which amount of waste, in the long run, becomes so large that it reaches the top edge of the inner bin 2. Usually, such waste is loosely arranged, that is to say it is possible to create space by compressing it slightly so that more waste can be added. Furthermore, it may be desirable to compress the waste in order to pull the top of the plastic bag 4 together and close it in order to dispose of it.

Figure 2:
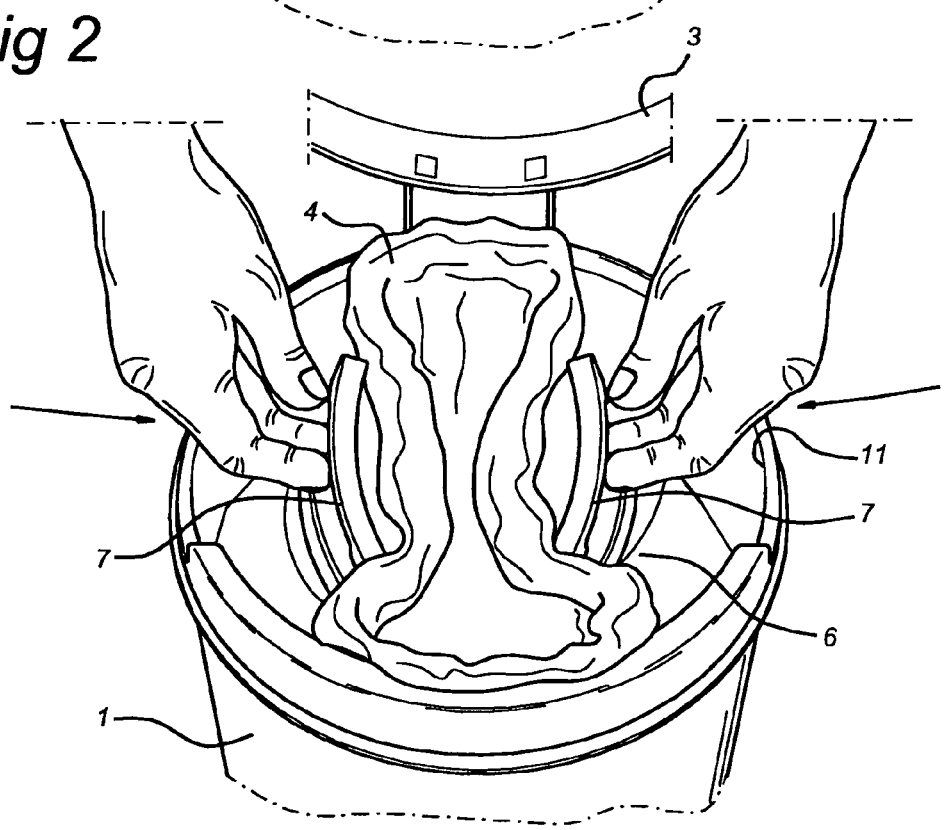
FIG. 2 shows the waste bin during a first step of the compression.
Figure 3:
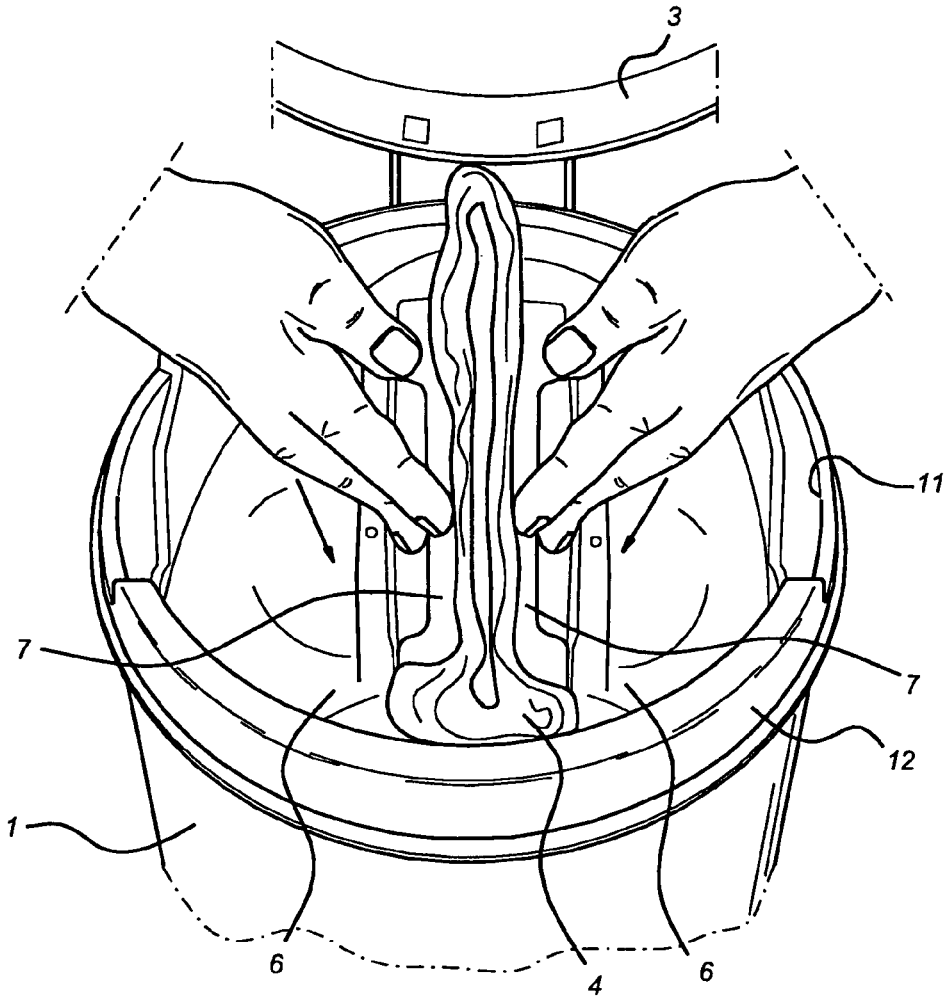
FIG. 3 shows the waste bin during a second step of the compression.

For this reason, the flexible sleeve 6 and the handles 7 are provided. As is illustrated in FIG. 2, the flexible sleeve 6 can be forced inwards and slightly downwards by gripping the handles 7. By this action, the waste is compressed, provided it has reached a sufficiently high level inside the inner bin 2. As is illustrated in FIG. 3, the handles 7 can be pressed downwards into a virtually horizontal position, in such a manner that the waste can readily be pushed in a downward direction.

Figure 4:
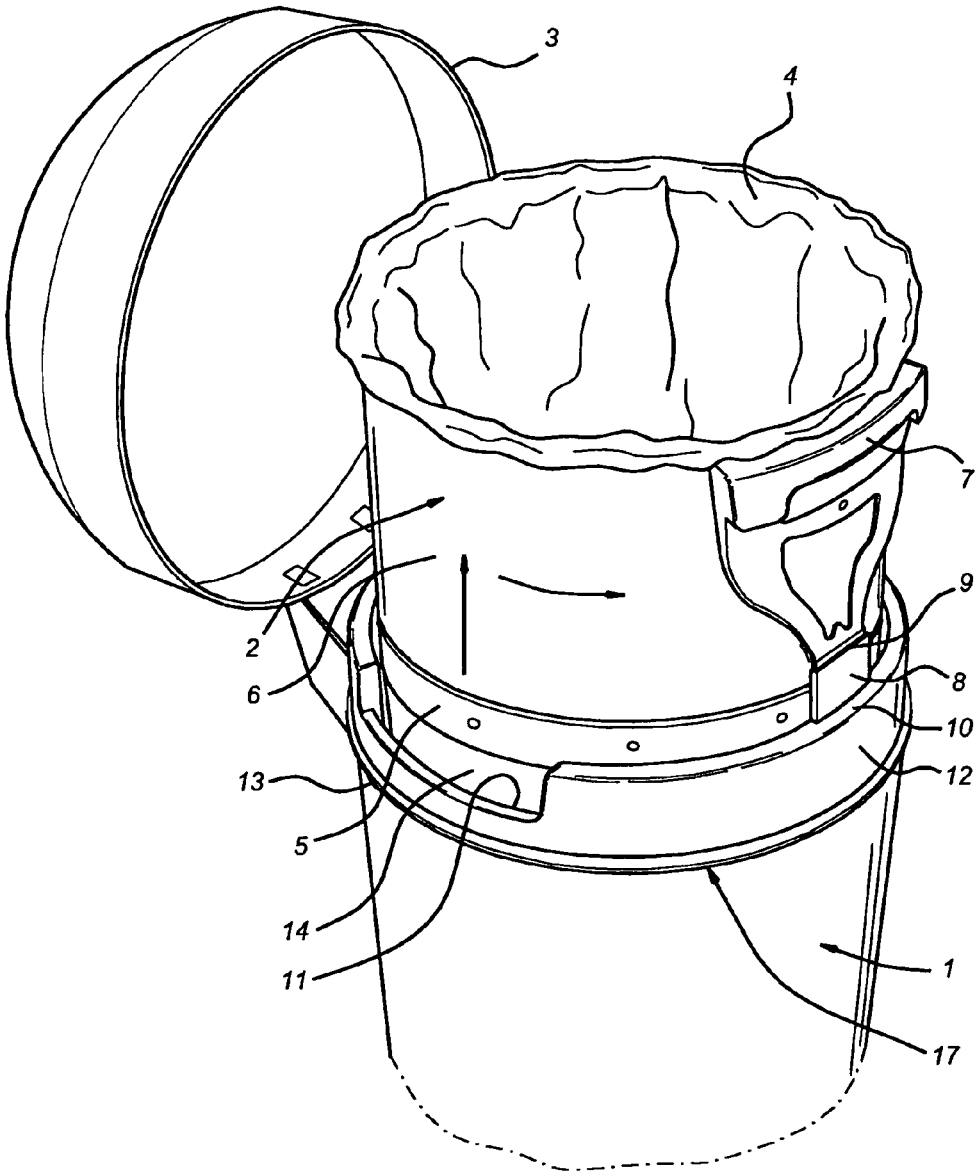
FIG. 4 shows the waste bin with the inner bin in a relatively high position on the outer bin.
Figure 7:
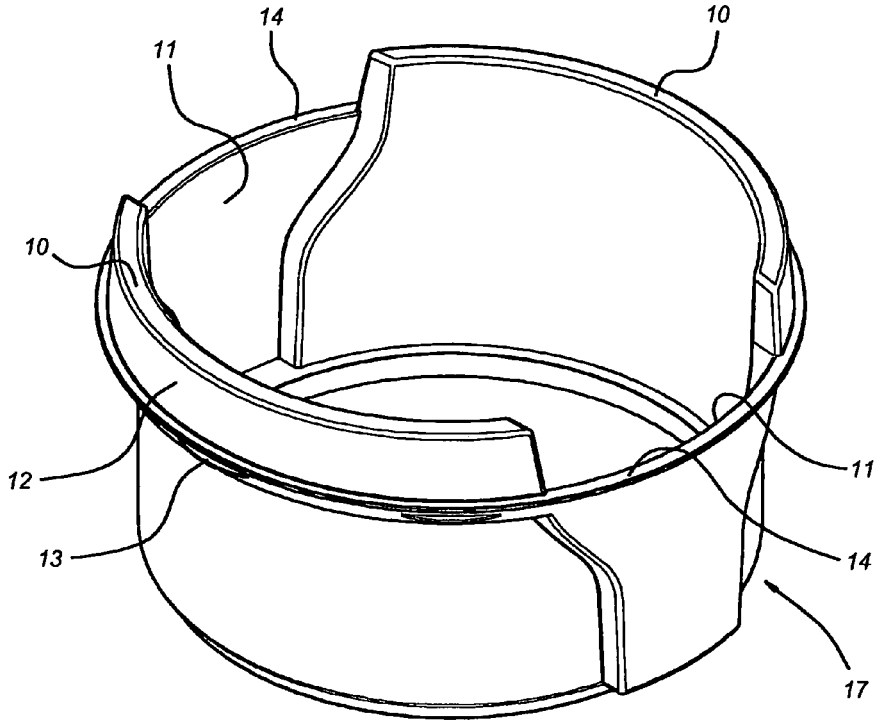
FIG. 7 shows a detail of the top edge (collar).

By moving the handles 7 back again, the inner bin 2 is released again, and further waste can be collected therein. The operation of moving back the handles 7 is assisted by the resilience of the flexible sleeve 6. The action of compressing the waste, as described above, can also be repeated a few times in succession in order to compress the waste further. Finally, the waste can be compressed in order to be able to pull the top of the flexible bag 4 together and to be able to seal it. In order to achieve this, the supports 8 are important. As illustrated in FIG. 4, these supports can be placed on a relatively narrow section 10 of the outer bin 1, in such a manner that the inner bin 2 is supported in a slightly raised position with respect to the outer bin 1. In this position, the bag 4 with the waste which has been collected and compressed therein can be readily be removed. The relatively narrow section 10 includes a sidewall 12 and forms part of the shaped collar 17, illustrated in FIG. 7. This shaped collar 17 forms part of the outer bin.

Figure 6:
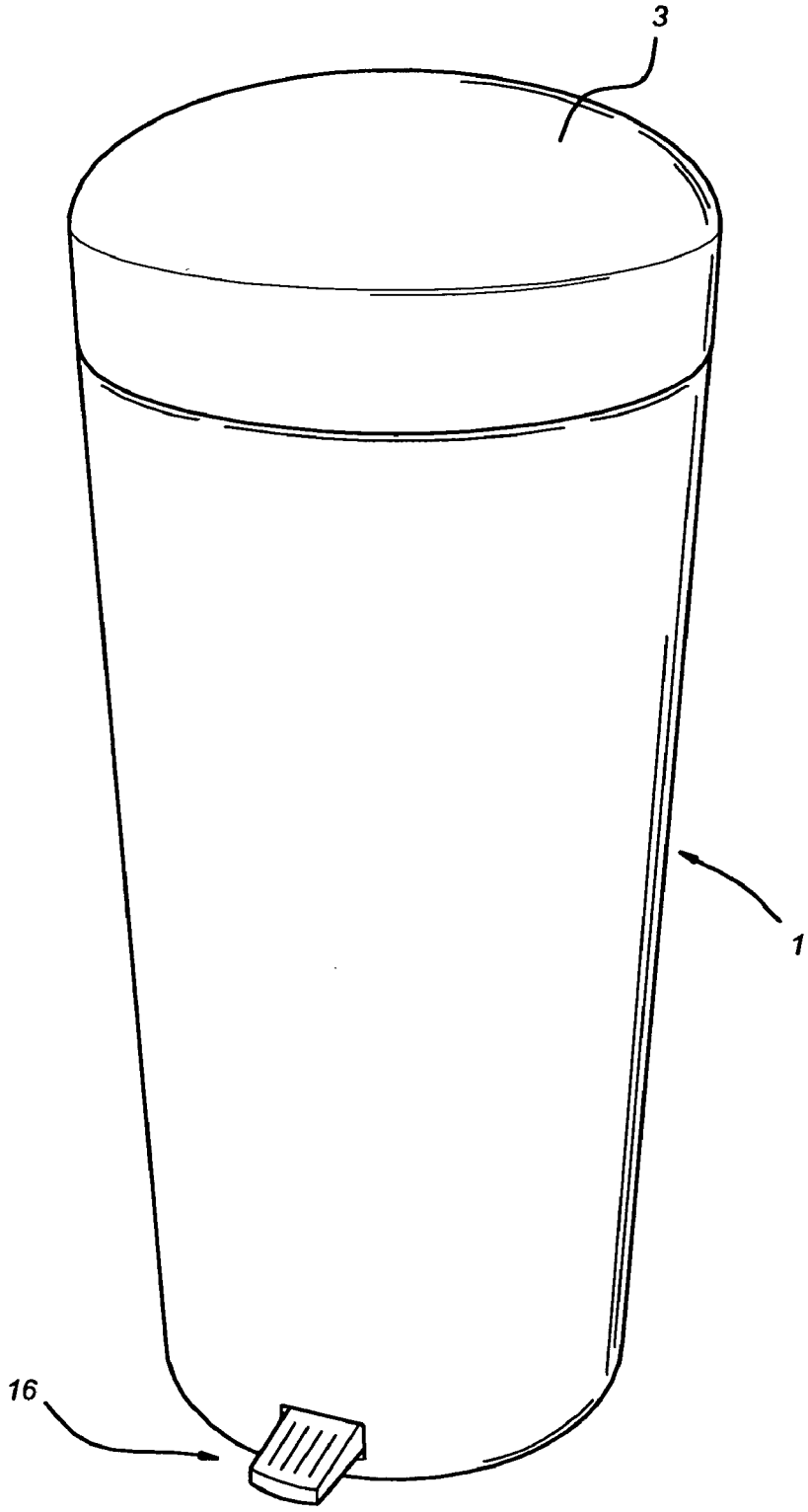
FIG. 6 shows the waste bin with a closed cover.

In the position illustrated in FIG. 4, the inner bin 2 is rotated slightly about the longitudinal axis with respect to the outer bin 1, in order to be able to reach the raised position. However, during normal use, as illustrated in FIG. 1, these supports 8 are in the relatively wide section 11 of the outer bin 1, so that the inner bin 2 can be accommodated completely inside the outer bin 1. This relatively wide section 11 also forms part of the shaped collar 17, and may, for example, correspond to the nominal internal diameter of the outer bin 1. By means of the ridge 13, the shaped collar is connected to the rest of the outer bin 1. As illustrated in FIG. 6, the cover fits around the shaped collar 17, in particular around the relatively narrow sections 10 thereof, and onto the ridge 13.

The handles 7 fit in the recesses 14 of the shaped collar 17, in such a manner that their top surface is level with the top surface of that receding section in the position as illustrated in FIG. 1. In addition, the handles 7 can then be pressed inwards with respect to the receding section 11, as is illustrated in FIGS. 2 and 3. Furthermore, the sleeve 6 is provided at the top with a thickened edge 15, which extends above the handles 7 and is situated just above the top of the outer bin 1 in the position illustrated in FIG. 1.

In the illustrated exemplary embodiment, a waste bin is used with a pedal 16, by means of which the cover 3 can be operated in a known manner, which is not described in any more detail. However, the invention is not limited to such a pedal bin, but can also be used with any other waste bin.

The invention claimed is:

1. A waste bin, comprising a container for holding waste and having a cover, and further comprising compressing means for compressing the waste inside the container, wherein the compressing means are displaceable between a nominal position and a compression position, wherein the compressing means in the compression position are configured to be moved inwards with respect to the nominal position to compress waste inside the container, wherein the compressing means comprise a part of the container that is movable at least transversely to a longitudinal axis of the waste bin, wherein the container comprises an outer bin and an inner bin accommodated in the outer bin, wherein the inner bin is adapted to accommodate the waste, and wherein the part of the container that is movable is a part of the inner bin, and wherein the inner bin comprises a rigid sub-bin and the part of the container that is movable comprises a flexible sleeve arranged on the sub-bin.

2. The waste bin according to claim 1, further comprising a first handle configured to move the sleeve manually between the nominal position and the compression position.

3. The waste bin according to claim 2, further comprising a second handle positioned diametrically opposite to the first handle.

4. The waste bin according to claim 2, wherein the first handle is attached to the flexible sleeve.

5. The waste bin according to claim 3, wherein the at least one of the handles is constructed of a substantially rigid material.

6. The waste bin according to claim 3, wherein the at least one of the handles when viewed in a direction transversely to the longitudinal axis of the waste bin, is at a distance beyond an upper edge of the sleeve.

7. The waste bin according to claim 3, wherein the at least one of the handles extends along the sleeve and is attached to the sub-bin.

8. The waste bin according to claim 7, wherein the at least one handle is hingedly attached to the sub-bin.

9. The waste bin according to claim 2, wherein the inner bin is adapted to accommodate a flexible bag such that an edge of the flexible bag is adapted to be turned over a top edge of the inner bin and be situated between the top edge and the first handle.

10. The waste bin according to claim 3, wherein the inner bin includes external supports, wherein at a first angular orientation of the inner bin and the outer bin with respect to one another, the supports fit into a substantially wide section of the outer bin to accommodate the inner bin completely inside the outer bin, and at a second angular orientation differing from the first angular orientation with respect to one another, of the inner bin and the outer bin, the supports are supported on a substantially narrow section of the outer bin, wherein the narrow section is situated at a top of the outer bin to support the inner bin on the outer bin in a substantially high position.

11. The waste bin according to claim 10, wherein the top of the outer bin includes a shaped collar comprised of the wide section and the narrow section.

12. The waste bin according to claim 8, wherein the at least one handle is hingedly attached to a support.

13. The waste bin according to claim 10, wherein the at least one of the handles fits in a corresponding recess on the top of the outer bin.

14. The waste bin according to claim 13, wherein a top side of the at least one handle is in the same plane as the top side of the outer bin when the at least one handle is situated in the corresponding recess.

15. The waste bin according to claim 14, wherein the flexible sleeve includes a thickened top edge extending over the top side of the at least one handle and the top side of the outer bin when the handle is situated in the corresponding recess.

16. The waste bin according to claim 10, wherein the cover is attached to the outer bin, wherein the cover is displaceable between an open position and a closed position.

17. The waste bin according to claim 16, wherein the top of the outer bin is formed by a recessed section connected to an outer bin body beneath it by means of a ridge, and wherein the cover, in a closed position, surrounds the recessed section and is connected to the ridge.

18. A method for collecting and compressing waste, comprising the steps of:

providing a waste bin having a container for holding waste and having a cover, and further comprising compressing means for compressing the waste inside the container, wherein the compressing means are displaceable between a nominal position and a compression position to compress waste inside the container, wherein the compressing means comprise a part of the container that is movable at least transversely to the longitudinal axis of the waste bin, wherein the container comprises an outer bin and an inner bin accommodated in the outer bin, wherein the inner bin is adapted to accommodate the waste and wherein the part of the container that is movable is a part of the inner bin, and wherein the inner bin comprises a rigid sub-bin and the part of the container that is movable comprises a flexible sleeve arranged on the sub-bin;

placing the waste in the inner bin;

increasing the waste up to a level of the compressing means delimiting an opening of the inner bin; and pressing a section delimiting the opening of the inner bin inwards to compress the waste.

19. The method of claim 18, further comprising the step of:

placing a flexible bag in the inner bin;

placing the waste in the flexible bag;

pressing the section delimiting the opening of the inner bin inwards to compress the waste in the flexible bag;

closing the flexible bag containing the compressed waste; and removing the flexible bag containing the compressed waste from the inner bin.

20. The method of claim 19, further comprising the step of:

pressing the section delimiting the opening of the inner bin inwards in order to compress the waste in the flexible bag while the inner bin is inside the outer bin.

* * * * *